US005303836A

United States Patent [19]

Childress

[11] Patent Number: 5,303,836

[45] Date of Patent: Apr. 19, 1994

[54] SHIPPING CONTAINER FOR HIGHLY ENRICHED URANIUM

[75] Inventor: Paul C. Childress, Lynchburg, Va.

[73] Assignee: The Babcock & Wilcox Company, New Orleans, La.

[21] Appl. No.: 95,642

[22] Filed: Jul. 21, 1993

[51] Int. Cl.[5] ..... G21F 5/00

[52] U.S. Cl. ..... 220/1.5; 220/4.04; 220/908; 976/DIG. 343

[58] Field of Search ..... 220/1.5, 464, 466, 4.04, 220/908; 206/524.5, 524.1; 976/342, 343, 344, 350, 352

[56] References Cited

U.S. PATENT DOCUMENTS 1,121,930 12/1914 Mather ..... 220/4.04 X
1,602,326 10/1926 Bjorkstedt et al. ..... 206/524.5 X
2,020,072 11/1935 Löwenstein ..... 206/524.5 X
3,432,666 3/1969 Nash et al. ..... 976/DIG. 343 X
4,058,479 11/1977 White et al. ..... 206/524.1 X
4,599,518 7/1986 Schmidt et al. ..... 976/DIG. 343 X
4,623,510 11/1986 Troy ..... 976/DIG. 343 X
4,626,382 12/1986 Stritzke et al. ..... 976/DIG. 343 X
4,783,309 11/1988 Popp et al. ..... 976/DIG. 343 X

*Primary Examiner*—Steven M. Pollard
*Attorney, Agent, or Firm*—Robert J. Edwards; D. Neil LaHaye

[57] ABSTRACT

A shipping container for highly enriched uranium. A heavy duty drum containing insulation material forms an outer container. Fiberboard and plywood form the insulation material and are shaped and sized to closely receive an inner container formed from stainless steel. The inner container has a closure lid that is bolted on and forms a seal through the use of O-rings.

10 Claims, 2 Drawing Sheets

SHIPPING CONTAINER FOR HIGHLY ENRICHED URANIUM

BACKGROUND OF THE INVENTION

1. Field of the Invention

The present invention is generally related to shipping containers for radioactive material and particularly to a shipping container for unirradiated highly enriched uranium.

2. General Background

Shipping containers previously used for shipping unirradiated highly enriched uranium were designed to meet the requirements of 10 CFR 71 as it existed before incorporation of new international standards (IAEA Safety Series 6, 1985 Edition). Containers that were used to meet the prior standards are typically steel containers with a threaded closure, with the steel container being centered in a steel shipping drum and isolated from the drum wall with fiberboard. These containers do not meet recent changes in NRC and IAEA(International Atomic Energy Agency) standards. This leaves a need for shipping containers that meet the new standards.

SUMMARY OF THE INVENTION

The present invention addresses the above need in a straightforward manner. What is provided is a shipping container for highly enriched uranium that meets the new standards. An outer container has insulators of fiberboard and plywood in a heavy duty drum that meets current NRC(10 CFR 71) and IAEA(Safety Series No. 6, 1985 Edition) standards. A drum that meets DOT standards 17C has a fiberboard and plywood liner that provides thermal insulation, impact protection, and axial support to an inner container. The inner container is formed from stainless steel and has a closure lid that forms a seal with the inner container to prevent leakage. The cover on the drum is closed using a heavy duty clamp ring with a bolt having a tamper proof seal.

BRIEF DESCRIPTION OF THE DRAWINGS

For a further understanding of the nature and objects of the present invention, reference should be had to the following description, taken in conjunction with the accompanying drawings in which like parts are given like reference numerals, and wherein.

DETAILED DESCRIPTION OF THE PREFERRED EMBODIMENT

Figure 1:
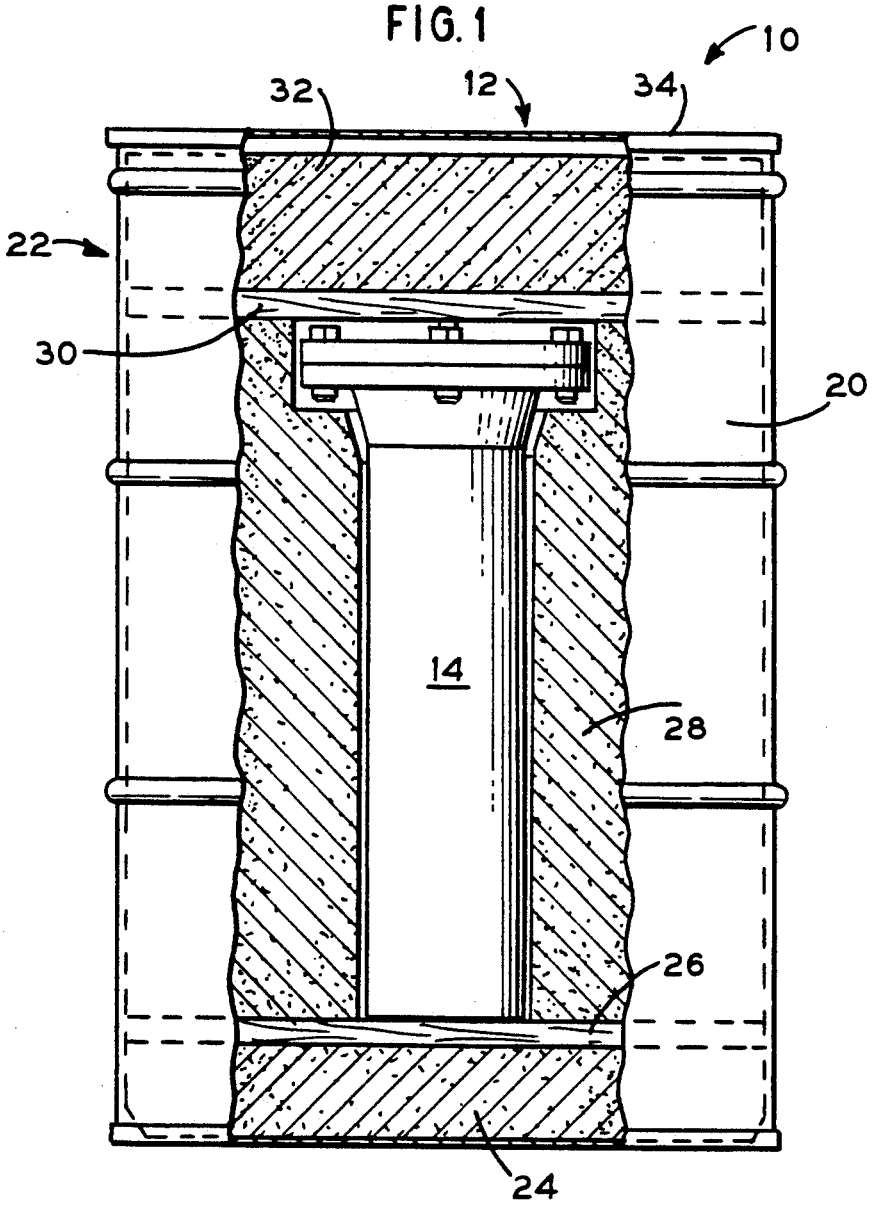
FIG. 1 is a side sectional partial broken away view of the invention.

Referring to the drawings, it is seen in FIG. 1, that the invention is generally referred to by the numeral 10. Shipping container 10 is generally comprised of outer container 12, inner container 14, closure lid 16 for inner container 14, and means 18 for attaching closure lid 16 to inner container 14 and forming a seal therebetween.

Figure 2:
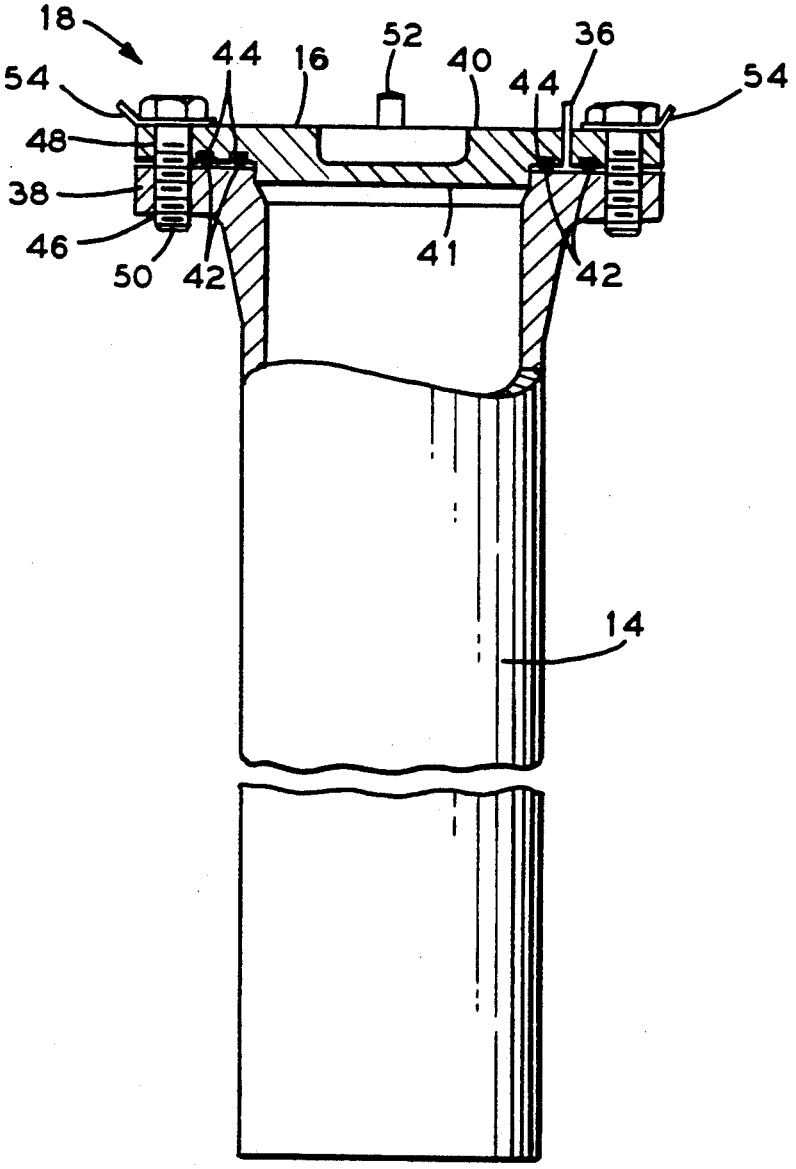
FIG. 2 is a side sectional view of the inner container of the invention.

As seen in FIG. 2, outer container 12 is formed from a fifty-five gallon heavy duty drum 20 that meets U.S. DOT(United States Department Of Transportation) specification 17C and insulation material 22 formed from fiberboard and fire retardant plywood. A first layer of fiberboard 24 is sized to be received and positioned across the bottom of drum 20. A first layer of plywood 26 is sized to be received in drum 20 and is positioned across the top of fiberboard layer 24. Fiberboard cylinder 28 is open at both ends and sized to be received in drum 20. The inner dimensions of fiberboard cylinder 28 are sized to closely receive inner container 14. A second layer of plywood 30 is sized to be received in drum 20 and is positioned on top of fiberboard cylinder 28. A second layer of fiberboard 32 is sized to be received in drum 20 and is positioned across the top of second plywood layer 30. Cover 34 is provided for drum 20 to secure the contents inside.

Inner container 14, seen in FIG. 3, has one open end and is preferably formed from austenitic stainless steel schedule 40S pipe(seamless or welded) and is sized to be received inside fiberboard cylinder 28 inside drum 20. The closed end may be a flat bottom cap machined from plate and welded to the pipe. In the preferred embodiment, the inner dimensions of inner container 14 are a five inch diameter and twenty-two inches long. This has been calculated as the largest volume possible for the transport of one hundred percent enriched (highly enriched) uranium while still being critically safe in the event of the ingress of water into inner container 14. The open end of inner container 14 is provided with flange 38. Test port 36 is provided in closure lid 40 to allow testing for every shipment. Closure lid 40 is sized to be received on the open end of inner container 14. Means 18 for attaching lid 40 to inner container 14 and forming a seal therebetween is provided in the form of O-rings 42, O-ring grooves 44 on lid 40, threaded bores 46 in flange 38, corresponding bores through lid 40, and bolts 50. In the preferred embodiment, eight threaded bores 46 are spaced around the circumference of flange 38 and corresponding bores 48 are provided through lid 40 to allow lid 40 to be bolted to inner container 14. Closure lid 40 is provided with shear lip 41 that extends 0.125 inch into inner container 14. Shear lip 41 centers lid 40 on container 14 and prevents any shear load from being transmitted to and through bolts 50. In the preferred embodiment, at least two sets of O-ring grooves 44 are provided on lid 40. O-rings 42 are received in grooves 44 such that a seal is formed between lid 40 and inner container 14 when lid 40 is bolted to inner container 14. Test port 36 is formed by a port through lid 40 that is located between O-rings 42 and allows testing to determine if there is any leakage once lid 40 has been bolted to container 14. The innermost O-ring forms the primary seal. Handling bail 52 is provided on lid 40 to allow remote handling of container 14 for loading into or out of outer container 12.

In operation, highly enriched uranium that may be in the form of solids, pellets, powder, crystals, or liquid solutions is loaded into inner container 14 and lid 40 is positioned on container 14 and bolted into place such that pressure on 0-rings creates a seal between lid 40 and container 14. Flat washers 54 placed between the bolt heads and closure lid 40 are then bent upward to insure that bolts 50 are not loosened during transport. Remote heavy lifting equipment may then be attached to lifting bail 52 for lifting and positioning container 14 in outer container 12 which has been lined with the first layers of fiberboard and plywood 24, 26 and fiberboard cylinder 28. The second layers of plywood and fiberboard 30, 32 are then placed over inner container 14. Inner container 14 and insulation material 22 are sized such that the maximum radial clearance between inner container 14 and insulation material 22 and between insulation material 22 and drum 20 is one-fourth inch. Cover 34 is then secured on drum 20 and shipping container 10 is ready for shipping. As indicated in NRC docket 71-9250, shipping container 10 has been analyzed and tested and deemed to conform to the most recent NRC and IAEA standards for shipping containers for highly enriched uranium. Inner container 14 is fabricated in accordance with ASME Code Section III (Subsection NB-4000), NUREG/CR-3019 (Category I), and NUREG/CR-3854 (Category I). Mating faces of flange 38 and closure lid 40 are machined flat to within 0.002 inches, and the face seal surfaces are finished to 16 RMS. Test port 36 is plugged during shipment.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A shipping container for highly enriched uranium, comprising:
   a. a heavy duty drum;
   b. insulation material received inside said drum, comprising:
      i. a first layer of fiberboard sized to be received in said drum and positioned across the bottom of said drum;
      ii. a first layer of plywood sized to be received in said drum and positioned across the top of said layer of fiberboard;
      iii. a fiberboard cylinder open at each end and sized to be received inside said drum;
      iv. a second layer of plywood sized to be received in said drum and positioned on top of said fiberboard cylinder; and
      v. a second layer of fiberboard sized to be received in said drum and positioned across the top of said second layer of plywood;
   c. an inner container having one open end and sized to be received in said fiberboard cylinder;
   d. a closure lid sized to be received on said inner container;
   e. means for attaching said closure lid to said inner container and forming a seal therebetween;
   f. said inner container being provided with a test port; and
   g. a cover sized to be received on said heavy duty drum.

2. The shipping container of claim 1, further comprising a handling bail on said inner container.

3. The shipping container of claim 1, wherein said inner container is formed from austenitic stainless steel.

4. The shipping container of claim 1, wherein said means for attaching and said closure lid to said inner container and forming a seal therebetween comprises:
   a. means for bolting said closure lid to said inner container; and
   b. an O-ring received in a groove on said closure lid.

5. The shipping container of claim 1, further comprising a test port provided in said closure lid.

6. A shipping container for highly enriched uranium, comprising:
   a. a heavy duty drum;
   b. insulation material received inside said drum, comprising:
      i. a first layer of fiberboard sized to be received in said drum and positioned across the bottom of said drum;
      ii. a first layer of plywood sized to be received in said drum and positioned across the top of said layer of fiberboard;
      iii. a fiberboard cylinder open at each end and sized to be received inside said drum;
      iv. a second layer of plywood sized to be received in said drum and positioned on top of said fiberboard cylinder; and
      v. a second layer of fiberboard sized to be received in said drum and positioned across the top of said second layer of plywood;
   c. an inner container having one open end and sized to be received in said fiberboard cylinder;
   d. a closure lid sized to be received on said inner container;
   e. means for attaching said closure lid to said inner container;
   f. two O-rings received in separate grooves in said closure lid;
   g. said inner container being provided with a test port; and
   h. a cover sized to be received on said heavy duty drum.

7. The shipping container of claim 6, wherein said inner container is formed from austenitic stainless steel.

8. The shipping container of claim 6, further comprising a test port provided in said closure lid.

9. The shipping container of claim 8, wherein said test port is located between said O-rings.

10. The shiping container of claim 8, wherein said closure lid is provided with a shear lip.

* * * * *